United States Patent [19]

Fessler

[11] Patent Number: 4,934,150

[45] Date of Patent: Jun. 19, 1990

[54] METHOD AND APPARATUS FOR CONTROLLING ICE THICKNESS

[75] Inventor: Herman S. Fessler, Coon Rapids, Minn.

[73] Assignee: The Cornelius Company, Anoka, Minn.

[21] Appl. No.: 282,536

[22] Filed: Dec. 12, 1988

[51] Int. Cl.[5] ..... F25D 3/00

[52] U.S. Cl. ..... 62/59; 62/139; 62/392; 62/394

[58] Field of Search ..... 62/139, 157, 201, 59, 62/68, 389, 394, 392, 228.2

[56] References Cited

U.S. PATENT DOCUMENTS

| | | | |
|---|---|---|---|
| 2,722,108 | 11/1955 | Hailey | 62/59 X |
| 2,724,950 | 11/1955 | Rothwell | 62/59 X |
| 2,973,630 | 3/1961 | Kriechbaum | 62/228.2 X |
| 2,994,206 | 8/1961 | Shaw et al. | 62/139 X |
| 3,496,733 | 2/1970 | Parker et al. | 62/139 |
| 4,448,036 | 5/1984 | Iannelli | 62/392 X |
| 4,480,441 | 11/1984 | Schulze-Berge et al. | 62/138 |
| 4,497,179 | 2/1985 | Iwans | 62/59 |
| 4,497,181 | 2/1985 | Kocher et al. | 62/139 |
| 4,706,467 | 11/1987 | Thorsen et al. | 62/139 |
| 4,754,609 | 7/1988 | Black | 62/59 |
| 4,843,830 | 7/1989 | Haul | 62/139 X |

*Primary Examiner*—Lloyd L. King

*Attorney, Agent, or Firm*—Henry C. Kovar; Sten Erik Hakanson

[57] ABSTRACT

A method of and apparatus for controlling the thickness of an ice bank as might typically be found in the beverage dispenser field, wherein the method has the steps of attaching an ice sensor to the cooling coils of the ice bank reservoir, selecting and setting an operatively fixed but user-selectable space between the sensor and the cooling coils, freezing a portion of water to form the ice bank, sensing the formation of ice at the sensor, and controlling the freezing responsive to the sensing of ice. The apparatus is usually flat and manufactured from a single piece of injection molded plastic. Included within a first region are a curved portion for interweaving between adjacent cooling coils, and a strap for wrapping around an additional cooling coil spaced from the adjacent coils. The apparatus bends to form a substantially triangular support for the sensor. The sensor is retained by clips to the second region and extends outside of the triangular area bounded by the three portions of the apparatus. The third portion of the apparatus is insertable through an interlocking opening in the first region, and can be interlocked at various insertion distances, enabling adjustable yet secure spacing between the sensor and the cooling coils.

30 Claims, 4 Drawing Sheets

METHOD AND APPARATUS FOR CONTROLLING ICE THICKNESS

BACKGROUND OF THE INVENTION

1. Field of the Invention

The method and apparatus of this invention pertains to the use and the structure of an ice sensor for an ice making refrigeration machine, an ice sensor bracket, and an ice making machine having an improved ice sensor for the refrigeration control.

2. Description of the Related Art

Ice bank dispensing systems are frequently used in the cooling and dispensing of carbonated water, soft drinks, and beer. The operation of such systems are well established and documented in such patents as R. C. Iwans' U.S. Pat. No. 4,497,179, W. J. Black's U.S. Pat. No. 4,754,609, and A. E. Parker et al's U.S. Pat. No. 3,496,733. Parker et al disclose in ice bank control which utilizes two sensing electrodes (38 and 42) and a common element (40). These electrodes require stable positioning. The sensing devices in the above cited patents rely on a mounting at the tank wall with the sensor(s) protruding into the ice bank reservoir. Clearly, the adjustment of such a prior art arrangement is at a minimum complex and inherently expensive due to the need to maintain secure attachment to the exterior wall, and in some instances, water tight attachment.

An adjustable ice sensor for an ice cube making machine is disclosed in C. J. Schulze-Berge et al U.S. Pat. No. 4,480,441. This sensor includes a mechanical hinge and pivot and an adjusting screw, and has several parts and is usable only for specific and limited applications.

OBJECTS OF THE INVENTION

It is an object of the present invention to provide a method and apparatus to control the thickness of an ice bank.

It is a further object of the present invention to provide a method and apparatus for sensing ice thickness which utilizes no operatively moving parts, and which therefore has nothing to wear out or break during normal operation.

It is a further object of the present invention to provide an adjustable apparatus for sensing ice thickness which is extremely reliable, and of simple and cost effective construction.

It is a further object of the present invention that the ice thickness sensor apparatus be readily accessible once the unit is delivered to a final destination, and that it be easily understood, adjusted, and if needed at a later date, replacable by persons who own, operate, repair, or otherwise rely upon it.

It is a further object of the present invention to provide a method and apparatus for controlling the thickness of ice.

It is a further object of the present invention to provide a new and improved ice sensor bracket for a refrigeration machine.

It is a further object of the present invention to provide an improved ice making refrigeration machine with an adjustable and locking ice sensor bracket.

SUMMARY OF THE INVENTION

A method for controlling the thickness of ice has the steps of fastening an ice sensor to a bracket, retaining the bracket and sensor to an ice making machine, selecting a fixed spacing between the ice sensor and a heat exchanger, setting and locking the bracket in the selected spacing position, applying water and freezing ice, and sensing the formation of ice at the selected fixed position and controlling the freezing.

A plastic ice sensor bracket for supporting an ice sensor has a generally flat plastic body with three discrete sections along a length of the body, the sections provide the functions of securement, sensor support, and sensor position locking, and joints between the sections enabling folding of the bracket into a geometrically stable structure.

An adjustable ice sensor bracket has securement structure, ice sensor support structure and lock structure for fixing the support structure in a plurality of positions.

An ice sensor for a refrigeration machine has a generally flat sensor bracket having a length divided into securement, sensor support and lock members, flexible structure adjoining the members, an ice sensor on the support member, and adjustment and locking structure for fixing the sensor in any one of a plurality of positions.

An ice making refrigeration machine has a heat exchanger, a refrigerant source, a refrigeration control, an ice sensor, and an ice sensor bracket having fastening, sensor supporting, sensor position adjusting and sensor position locking structure.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
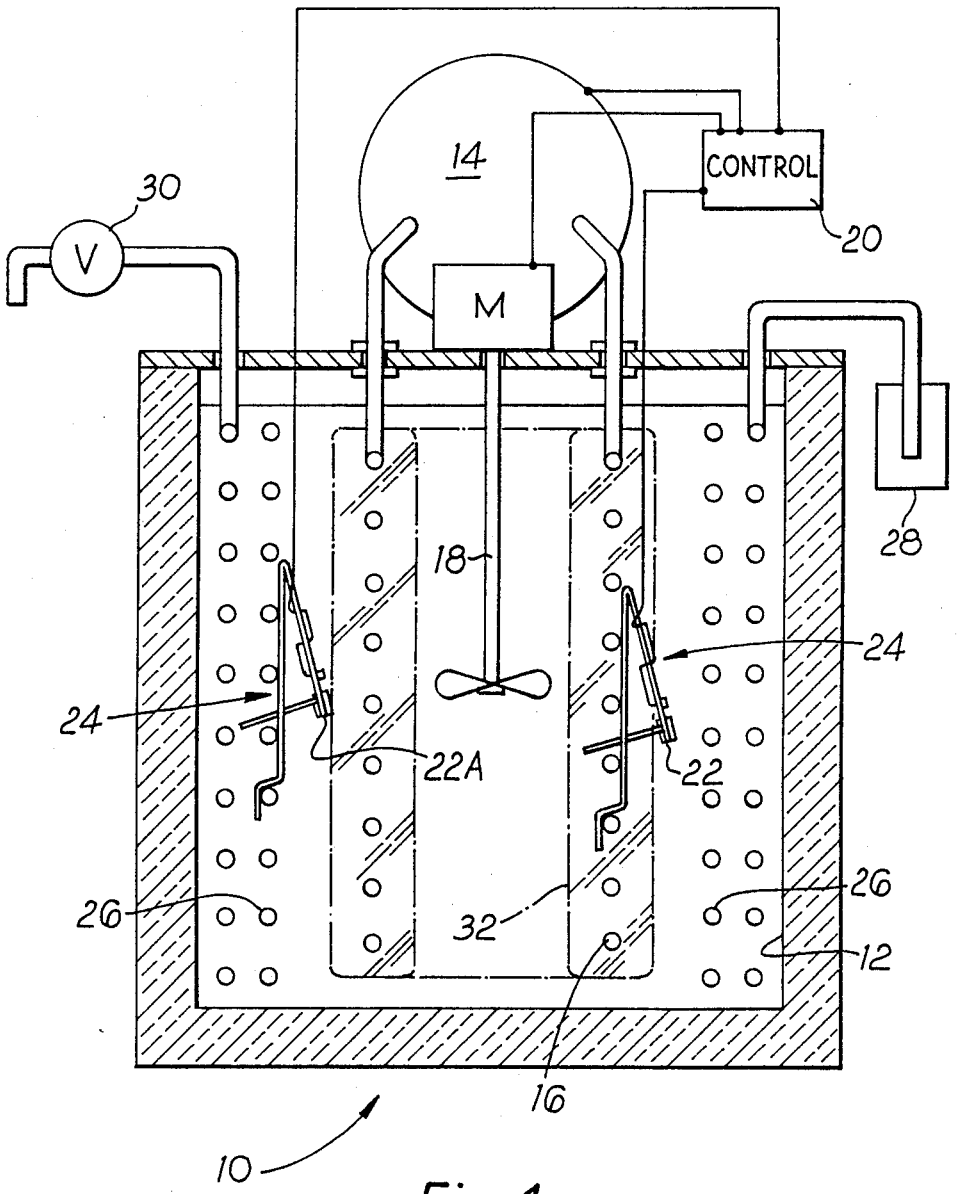
FIG. 1 is schematic elevational view of an ice making refrigeration machine, having an ice sensor and an ice sensor bracket.
Figure 2:
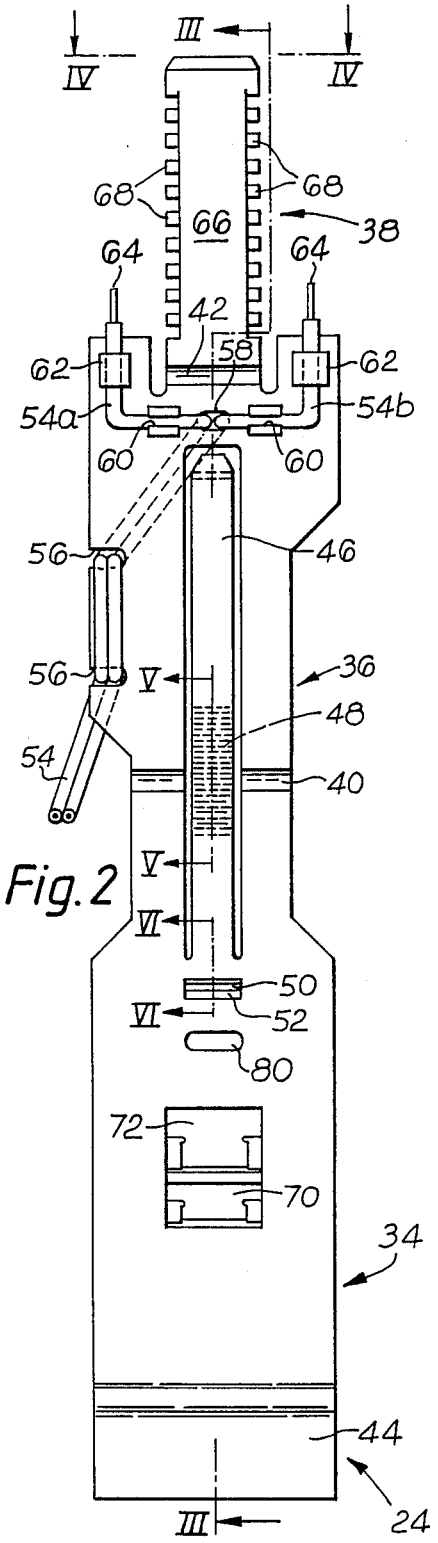
FIG. 2 is a plan view of the bracket in the machine of FIG. 1.

An ice making refrigeration machine, is shown in FIG. 1 and generally indicated by the numeral 10, and includes a water tank 12. Machine 10 also includes refrigeration means 14, represented schematically, having a heat exchanging evaporator or cooling coil 16. In the preferred embodiment coil 16 is generally a helical coil of tubing forming a conduit for refrigerant from the refrigeration system 14. Machine 10 also includes a water moving device 18, which is shown to be an electric motor and an immersed propeller, a refrigeration control 20 which is operatively converted to control the refrigeration means 14 and turn the refrigerating means 14 on or off, an ice sensor 22, and a new and novel bracket, generally indicated by the numeral 24, for supporting, adjusting and locking the position of the ice sensor 22. The machine 10 is shown to be a cold beverage dispenser for beverages such as carbonated soft drinks, and the machine 10 may have a heat exchanger coil 26 in contact with the water and therefore in thermal heat exchange relationship with cooling coil 16. The heat exchanger 26 is preferrably a plurality of metal tubing coils for fluidly conveying beverage from a beverage source 28 into heat exchange relationship with the evaporator cooling coil 16 and then to one or more dispensing valves 30. The coils 16, 26 are spaced from each other and both are immersed in water in the tank 12. When the refrigerating means 14 is running, the water is chilled and a quantity of ice, the outline of which is indicated by the numeral 32, is frozen by and on the evaporator cooling coil 16. The water mover 18 circulates water over the coils 16, 26 and heat from the beverage is absorbed into the moving water and then utilized to melt the ice 32, down. The first and evaporator heat exchanger builds, rebuilds, and maintains a quantiy of ice 32. This type of beverage refrigeration system is generally referred to as an "ice bank" system and a specific example of this type of machine is shown and described in U.S. Pat. No. 4,497,179 of February 5, 1985.

An important feature of the method and apparatus of this invention is the use and provision of the new and very useful ice sensor bracket 24 which is shown in greater detail in FIGS. 2–9.

Figure 3:
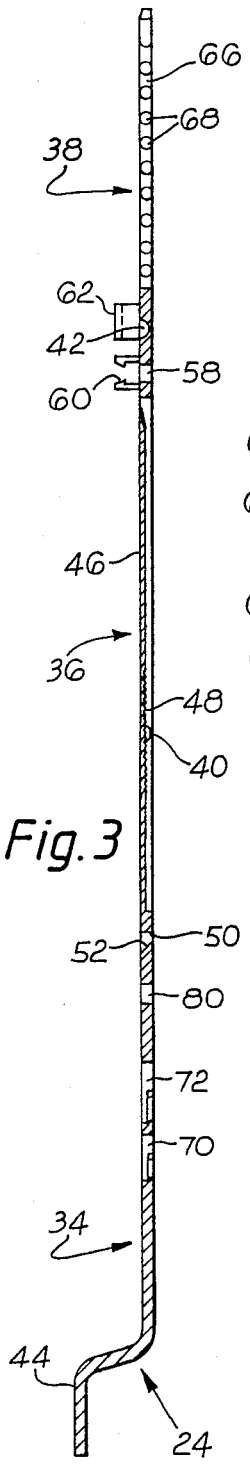
FIG. 3 is a side elevational view of the bracket of FIG. 2.
Figure 4:
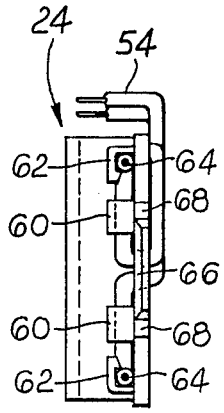
FIG. 4 is an end elevational view of the bracket of FIG. 2.
Figure 5:
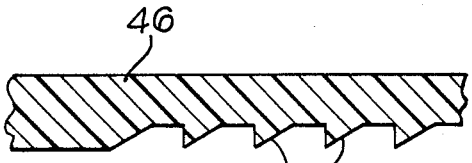
FIG. 5 is a sectional view taken through lines V—V of FIG. 2.
Figure 6:
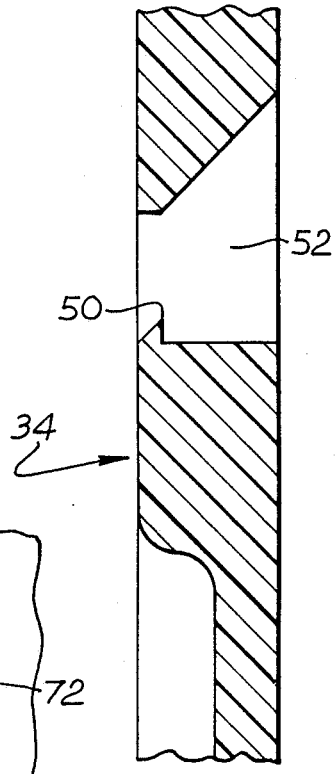
FIG. 6 is a sectional view taken through lines VI—VI of FIG. 2.
Figure 9:
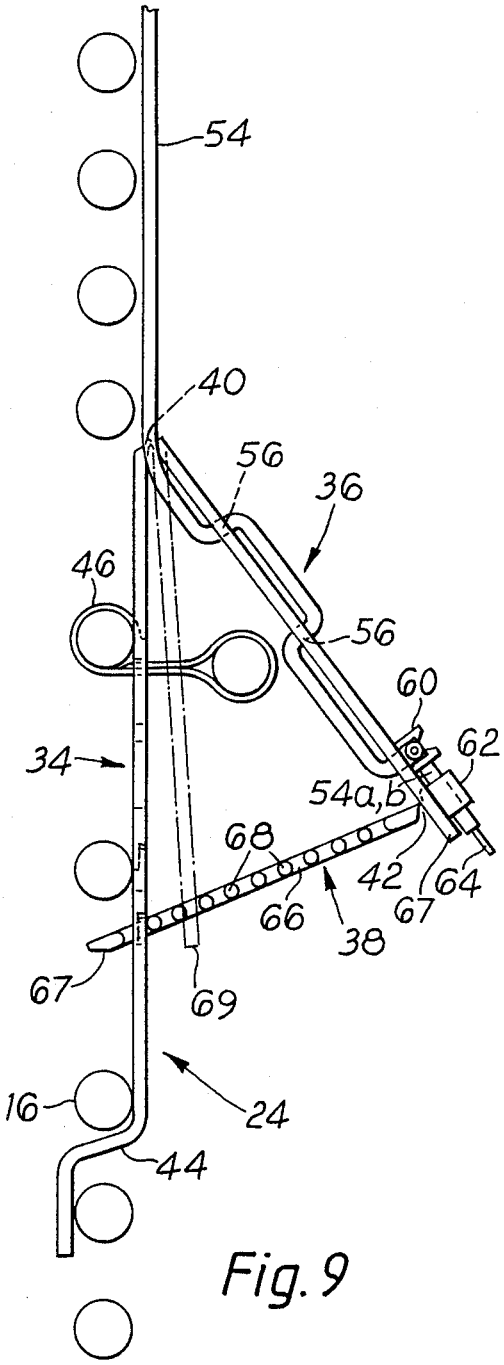
FIG. 9 is an elevational detail of the sensor and bracket in the machine of FIG. 1.

The bracket 24 is initially flat as best shown in FIG. 3 and is injection molded in a single shot of an integral single piece of plastic, such as polypropylene or polyethylene, which is di-electric and non-galvanic. The bracket 24 is divided along its length into a securement section 34, a sensor support section 36, and a locking section 38; these sections 34, 36, 38 are functionally separated from each other by at least two living hinges 40, 42. As shown, the securement section 34 is hinged one end of the support section 36 and the lock section 38 is to the other end; it is also usable to hinge both the support section 36 and the lock section 38 from securement section 34. The securement section 34 has an outer end with a generally Z-shaped offset first retainer 44 that hooks through the cooling coil 16 and over a tube as best seen in FIG. 9, the securement section also has a binding strap type second retainer 46 that binds around a tube as also best seen in FIG. 9. The strap retainer 46 has a plurality of teeth 48 that hook upon an abuttment 50 in a strap retainer slot 52. The outer and distal end of the strap retainer 46 has a locking notch 52 to be inserted into the slot 52 for locking the strap retainer teeth 48 to the abuttment 50. Then, as seen in FIG. 9, the bracket is fastenable while still flat, to at least two tubes of the coaling coil 16.

The sensor support section 36 has integral structure for receiving the ice sensor 22, which is preferrably a two wire electrical conductivity tester as shown or which may be a bulb type as has been historically used. The preferred sensor 22, has a two wire lead 54 which is threaded through firstly a strain relief 56 and then secondly an eyelet 58. The two wire lead 54 is then separated and each one of the leads 54*a*, 54*b* is captivated in a sensor splitter clip 60 and then is held and fastened to support section 36 by a respective sensor fastener clip 62. A distal end of each of the leads 54*a*, 54*b* is stripped of its insulation and serves as the sensor electrical probe 64 in the water or the frozen ice 32.

Figure 7:
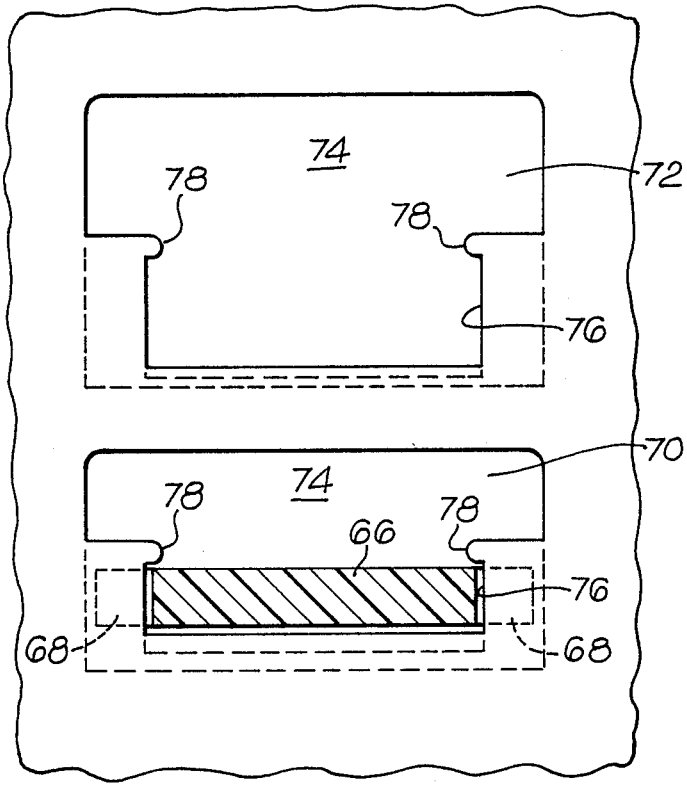
FIG. 7 is a detail plan view of the bracket of FIG. 2.
Figure 8:
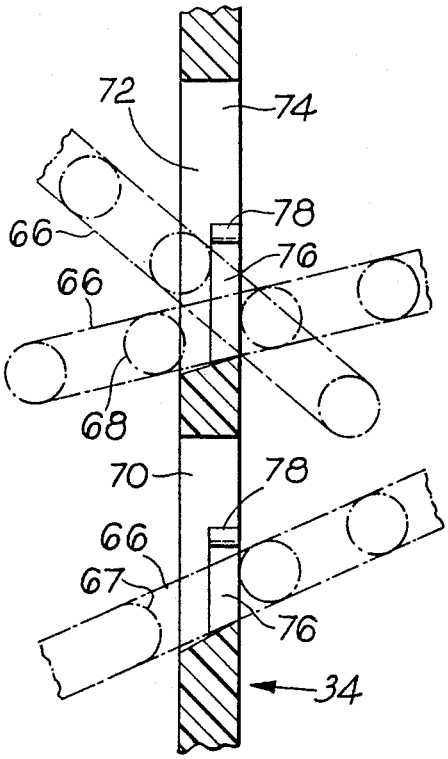
FIG. 8 is an elevational view of the adjustment and locking mechanism of the bracket of FIG. 2.

The lock section 38 has generally constant cross-section elongate cantilevered tongue 66 that has a plurality of lock teeth 68 on its sides. The lock section 38 works in co-operation with first and second position lock openings 70, 72 in the securement section 34. Each of the lock openings 70, 72 as best seen in FIGS. 7 and 8 has a relatively large through opening 74 which freely accepts the entire lock section, a relatively smaller holder section 76 which accepts the tongue 66 in between adjacent lock teeth 68, and at least one snap detent 78 for keeping the tongue 66 in the holder section 76. The lock opening 70, 72 are spaced one above the other and enable usage of the bracket 24 on almost any tube type coaling coil 16, regardless of the spacing between the tubes. The locking section 38 can be fixedly fastened in either of the lock openings 70, 72, at a maximum extension position 67 or a minimum extension position 69, or any of the plurality of positions in between as defined by the plurality of spaced apart lock teeth 68. The securement section has an extra retainer aperture 80 for conventional plastic wire ties.

The entire integral bracket 24 is injection molded in a single shot, without the use of slides in the mold. The bracket 24 is initially flat, save for the first retainer 44 which is a relatively single and uncostly offset in the mold faces.

In the practice of the method of the present invention and in the use of the bracket 24, the bracket 24 is secured to the machine 10. The bracket 24 is shown on the right side of FIG. 1 as being secured as previously described, to the first or evaporator cooling coil 16. When fastened to the evaporator coaling coil 16, the bracket enables adjustment of the sensor probes 64 predicated upon the distance from the evaporator cooling coil 16. The bracket 24 may alternatively be mounted upon the beverage heat exchanger coil 26 as shown on the left side of FIG. 1, enabling adjustment of the sensor probes predicated upon distance from the beverage heat exchanger 26 rather than distance from the evaporator cooling coil 16.

The sensor 22 and its leads 54 and probes 64 are preassembled to the bracket 24, while the bracket 24 is in the initially flat form and this ice sensor assembly is inventoried and supplied to a production line or an end user in the flat configuration.

Upon securement of the securement section 34 to the machine 10, the support section 36 and locking section 38 are folded about the hinges 40, 42 closed together to form a structurally stable plane figure. A "plane figure" is a general term referring to a figure bounded by lines; in this case the figure is a plane figure bounded by straight lines and is more specifically a triangle bounded by three straight lines as clearly shown in FIG. 9. The triangular plane figure has two sides formed by the securement section 34 and support section 36 which are of constant length, and the third side formed by the locking section 38 is of adjustably variable length to adjust and vary the position of the ice sensor probes 64 as desired. The lock section 38 is pushed into an through a selected one of the lock openings 70, 72 and pushed past the snap detents 78 to lock and fix the ice sensor 22 in place. To adjust the position of the ice sensor 22 and therefore the thickness of ice to be frozen, the lock section 38 is pulled past the snap detents 78 and into the through opening 74 wherein it is moved and reset as described into a new selected position.

This particular method and apparatus can be used on both new and old ice making machines, wiil fit on almost any evaporator or cooling coil and is easily and positively adjusted manually without the need for or use of tools.

The foregoing description of the preferred embodiment of the present invention is in no way intended to limit the breadth of the present invention. Changes or variations which are within the scope of one of ordinary skill in the art are considered to be encompassed within the foregoing description.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A method for controlling the thickness of ice in a refrigeration machine having cooling coil comprising the steps of:

(a) fastening an ice sensor to an adjustable ice sensor bracket;

(b) retaining securement structure of the bracket to the refrigeration machine;

(c) selecting an operatively fixed spacing between said ice sensor and said cooling coil;

(d) setting said operatively fixed spacing by adjusting and locking said bracket and fixing the position of the ice sensor in a selected one of a plurality of available positions to obtain said selected spacing;

(e) applying water in said machine and on to said coaling coil;

(f) freezing at least a portion of said applied water to form ice;

(g) sensing the thickness of the ice with said fixed position ice sensor; and (h) controlling said freezing responsive to said sensing at the selected spacing.

2. The method of claim 1 wherein said step of retaining is performed by the use of hands without additional tools or equipment.

3. The method of claim 1 wherein said step of retaining comprises the additional steps of:

(a) inserting a first retainer on securement structure into a space between two adjacent portions of said cooling coil;

(b) bending a second and elongate retainer about a first end which is adjointed to the securement structure and thereby causing a second and distal end of said second retainer to protrude from said securement structure;

(c) wrapping said second retainer around a portion of said cooling coil, and (d) threading said second end of said second retainer through at least one location on said securement structure.

4. The method of claim 3 further comprising the additional step of interlocking said second end of said second retainer to said location.

5. The method of claim 4 wherein said setting step is performed by use of hands without additional tools or equipment.

6. The method of claim 1 wherein said adjusting of said bracket comprises the additional steps of:

(a) bending said bracket in at least two locations and forming a geometric region having at least three sides;

(b) choosing a desired angular relationship between the sides of said geometric region;

(c) interlocking at least two portions of said bracket together and structurally fixing said desired geometric region; and in which (d) said ice sensor has been fastened to one of said sides and is spaced from and fixed with respect to said securement structure by said geometric region.

7. The method of claim 6, including the further step of adjusting the shape of the geometric region to set the fixed spacing.

8. The method of claim 1, wherein the ice sensor is fastened to said bracket while the bracket is generally flat.

9. A plastic ice sensor bracket for supporting an ice sensor in an operatively fixed position comprising a generally flat plastic body having:

(a) at least three discrete sections along a length of the body wherein said discrete sections provide the functions of securement of said bracket to a refrigeration machine, support of said ice sensor, and locking of said ice sensor with respect to said machine; and (b) joints between said sections, said bracket being foldable from an initially generally flat configuration to a geometrically stable structure mountable to said machine.

10. The bracket of claim 9 additionally comprising means for altering the geometry of said geometrically stable structure while said bracket is secured to said machine.

11. The bracket of claim 9, in which said bracket body includes:

(a) a securement retainer;

(b) complete sensor fastening means for fastening the ice sensor to the bracket; and (c) strain relief means for holding a lead from the ice sensor to a remotely located refrigeration control.

12. An adjustable ice sensor bracket for a refrigeration machine having an evaporator for the freezing of ice thereon, comprising:

(a) securement means for securing said bracket to said refrigeration machine;

(b) an ice sensor support movably adjoined to said securement means, said support being selectively movable closer to and further from said securement means; and (c) lock means for locking said support in any one of a plurality of selectable positions with respect to both of said evaporator and said securement means, for selective adjustment of the thickness of ice to be frozen on the evaporator.

13. The bracket of claim 12 wherein said bracket is contiguous.

14. The bracket of claim 13 wherein said contiguous bracket is a molded plastic.

15. The bracket of claim 12 wherein said securement means includes an integral retainer strap.

16. The bracket of claim 12 further comprising a hinge between said securement means and said support means.

17. The bracket of claim 12 wherein said lock means is adjustable at least in part about a hinge, said hinge joining said lock means to one of said securement means and said sensor support.

18. The bracket of claim 12 in which said securement means includes an offset retainer means for insertion between an adjacent pair of heat exchanger coils of the machine.

19. The bracket of claim 12 wherein said plurality of selectable positions is comprised by a plurality of discrete positions between a maximum ice thickness position and a minimum ice thickness position.

20. The bracket of claim 12 wherein said securement means, said sensor support means, and said lock means each form one side of a geometrical shape having at least three sides when said bracket is operatively configured.

21. The bracket of claim 20 wherein said bracket is generally planar prior to said operative configuration.

22. The bracket of claim 12 wherein said bracket is galvanically inactive.

23. An ice sensor for a refrigeration machine, comprising:

(a) a generally flat sensor bracket having;
  (1) a length divided into a bracket securement member, a sensor support member, and a lock member, and
  (2) flexible means adjoining said members to each other for enabling bending of the bracket from a generally flat fabricated shape into a plane figure usage shape;
(b) an ice sensor fastened to said sensor support member;
(c) retainer means for securing said securement member to the machine;
(d) adjustment means in said bracket and operable after said bracket has been secured to the machine for moving said sensor support member and said sensor to a plurality of positions; and
(e) locking means in said bracket for locking said sensor support member and said ice sensor in any one of the plurality of positions.

24. The ice sensor of claim 23, in which said flexible means
  (1) hingedly fasten one end of the sensor support member to the securement member, and
  (2) hingedly fasten the lock member to a second end of the sensor support member, and in which said ice sensor is mounted on said sensor support surface adjacent to said second end.

25. The ice sensor of claim 23, in which said securement member has means for retaining the bracket to a tubular cooling coil having a plurality of spaced apart tubes, and means for directing the lock member in between adjacent said tubes, when said bracket is secured on the cooling coil and is in the usage shape.

26. An ice making refrigeration machine having:

(a) a cooling coil;
(b) means for providing water in thermal exchange contact with the cooling coil;
(c) refrigeration means for providing compressed refrigerant for the freezing of ice in the water;
(d) a control operatively connected to said refrigeration means;
(e) an ice sensor operatively connected to said control;
(f) an ice sensor bracket mounting said sensor in said machine, said bracket having:
  (1) means for fastening the bracket to said machine,
  (2) means for supporting the sensor,
  (3) means for adjusting the position of the sensor support, and
  (4) means for locking the sensor support and the sensor in a fixed position with respect to the cooling coil, while said bracket and sensor are mounted on the machine.

27. The ice machine of claim 26, wherein said fastening means include at least one retainer for fastening of the bracket directly upon the cooling coil.

28. The ice machine of claim 26, in which said bracket is a single structure having at least two hinge elements in between the fastening, supporting, and adjusting means.

29. The ice machine of claim 26, in which said adjusting means is positionally adjustable through said cooling coil.

30. The ice machine of claim 26, in which the fastening, supporting, and adjusting means are all in a single integral molded plastic component having integral plastic hinges providing movability for adjustment of the ice sensor position.

* * * * *